US005516262A

United States Patent [19]

Rhee et al.

[11] Patent Number: 5,516,262

[45] Date of Patent: May 14, 1996

[54] AUTOMATIC PUMP

[75] Inventors: Dong I. Rhee, Kyungki-Do; Seong B. Lee, Seoul, both of Rep. of Korea

[73] Assignee: Goldstar Co., Ltd., Rep. of Korea

[21] Appl. No.: 382,851

[22] Filed: Feb. 3, 1995

[30] Foreign Application Priority Data

Feb. 8, 1994 [KR] Rep. of Korea ..... 2458/1994

[51] Int. Cl.[6] ..... F04D 29/00

[52] U.S. Cl. ..... 415/197; 415/52.1; 415/58.4; 415/147

[58] Field of Search ..... 415/11, 52.1, 58.4, 415/146, 147, 197, 200

[56] References Cited

U.S. PATENT DOCUMENTS 3,168,870 2/1965 Hornschuch ..... 415/147

*Primary Examiner*—Edward K. Look
*Assistant Examiner*—Christopher Verdier
*Attorney, Agent, or Firm*—Ostrolenk, Faber, Gerb & Soffen

[57] ABSTRACT

An improved automatic pump capable of advantageously reducing manufacturing processes thereof as well as significantly preventing pressure decrease in a pump assembly by providing a pressure control tube and removing a sealing process thereof, which includes a motor for transmitting driving force to corresponding elements thereof; a working chamber formed in front of the motor, in which an impeller drivingly connected to a rotary shaft of the motor is disposed; a pump casing attachably attached to a predetermined portion of the working chamber and having a pressure tank with a predetermined size thereof; and a pressure control tube equipped with an air pressuring port disposed at a predetermined portion of the pump casing.

7 Claims, 6 Drawing Sheets

AUTOMATIC PUMP

BACKGROUND OF THE INVENTION

1. Field of the Invention

The present invention relates to an automatic pump, and particularly to an improved automatic pump capable of advantageously reducing manufacturing processes thereof as well as significantly preventing pressure decrease in a pump assembly by providing a pressure control tube and obviating a sealing process thereof.

2. Description of the Conventional Art

FIGS. 1A and 1B show a construction of a conventional automatic pump, which includes a motor 1 for transmitting driving force to corresponding elements thereof, an impeller 3 cooperatively working with and affixed to a rotary shaft 2 of the motor 1, a working chamber 4 sufficiently formed in front of the motor 1, and a pump casing 5 attached to a predetermined portion of the working chamber 4.

The pump casing 5, as shown in FIG. 2, includes an intake tube 7 disposed in the working chamber 4 and projecting from the front portion of the pump casing 5, an intermediate wall 9 disposed between the working chamber 4 and the pump casing 5 and at a predetermined portions of which a plurality of pressure control openings 8 are provided, an air pressuring port 10 formed on a predetermined portion of the front surface of the pump casing 5, and a rubber blade 12 for encasing a predetermined portion of the pump casing 5 spaced apart from the internal wall 1 la of the pump casing 5. In addition, reference numeral 11 denotes a pressure tank, which is provided between the internal wall 11*a* of the pump casing 5 and the rubber blade 12.

Meanwhile, an exhausting tube 6 is disposed at a predetermined portion of the upper side of the working chamber 4 for exhausting water flowed from the intake tube 7 through the working chamber 4 to the outside thereof.

As described above, the conventional automatic pump lets water flow into the working chamber 4 through the intake tube 7 as the impeller 3 rotates by receiving driving force from the motor 1. At this time, the water pressured at the working chamber 4 flows toward the outside through the exhausting tube 6. Here, the residual water in the working chamber 4 flows into the pump casing 5, as shown in FIG. 3, thereby disadvantageously decreasing the usable space of the pressure tank 11. That is, the rubber blade 12 is pressured due to the increasing pressure in the pump casing 5.

Meanwhile, in the conventional automatic pump, for example, in case that the automatic pump is stopped, the exhausting pressure therein becomes unstable, so that the pressured air in the pressure tank 11 formed between the pump casing 5 and the rubber blade 12, as shown in FIG. 4, presses against the rubber blade 12. That is, when the pressure against the rubber blade 12 is removed, the pressure tank 11 returns back to its original state, whereby the water in the pump casing 5 flows toward the exhausting tube 6 through the pressure control openings 8 by means of the pressure of the rubber blade 12, which is indicated by the arrows in the pressure tank 11 shown in FIG. 4.

However, although the A- and B-portions formed between the rubber blade 12 and the pump casing 5 shown in FIG. 2 are sealed for preventing the leakage of water therethrough, the leakage performance may not be achieved due to the leakage of pressure therein when the pressure in the pump casing 5 increases. In addition to that, the assembling process may become complicated due to an additional sealing process. In addition, the conventional automatic pump has restrictions to alternatively dispose the rubble 12 and the sealing portions A and B shown in FIG. 2, whereby more compact size may not be achieved thereby.

SUMMARY OF THE INVENTION

Accordingly, it is an object of the present invention to provide an automatic pump.

It is another object of the present invention to provide an improved automatic pump capable of advantageously reducing manufacturing processes as well as preventing the pressure decrease in the pump assembly by providing a pressure control tube and by avoiding a sealing process thereof.

To achieve the above objects, there is provided an improved automatic pump, which includes a motor for transmitting driving force to corresponding elements thereof; a working chamber romped in front of the motor, in which an impeller drivingly connected to a rotary shaft of the motor is disposed; a pump casing attachably attached to a predetermined portion of the working chamber and having a pressure tank with a predetermined size; and a pressure control tube equipped with an air pressuring port disposed at a predetermined portion of the pump casing.

DETAILED DESCRIPTION OF THE INVENTION

Figure 5A:
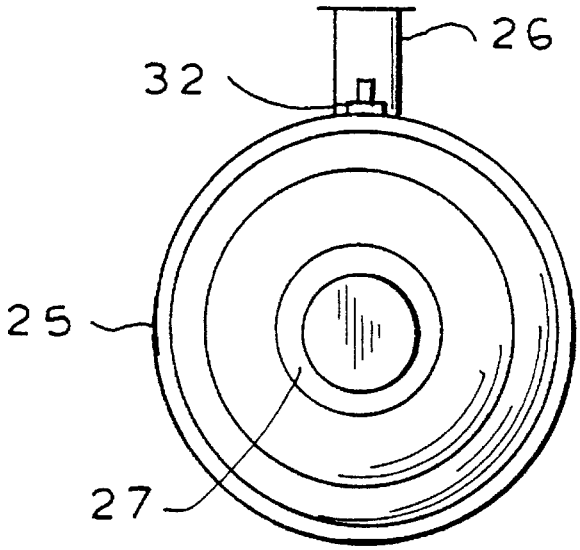
FIG. 5A is a front view showing a construction of an automatic pump of a first embodiment according to the present invention.
Figure 5B:
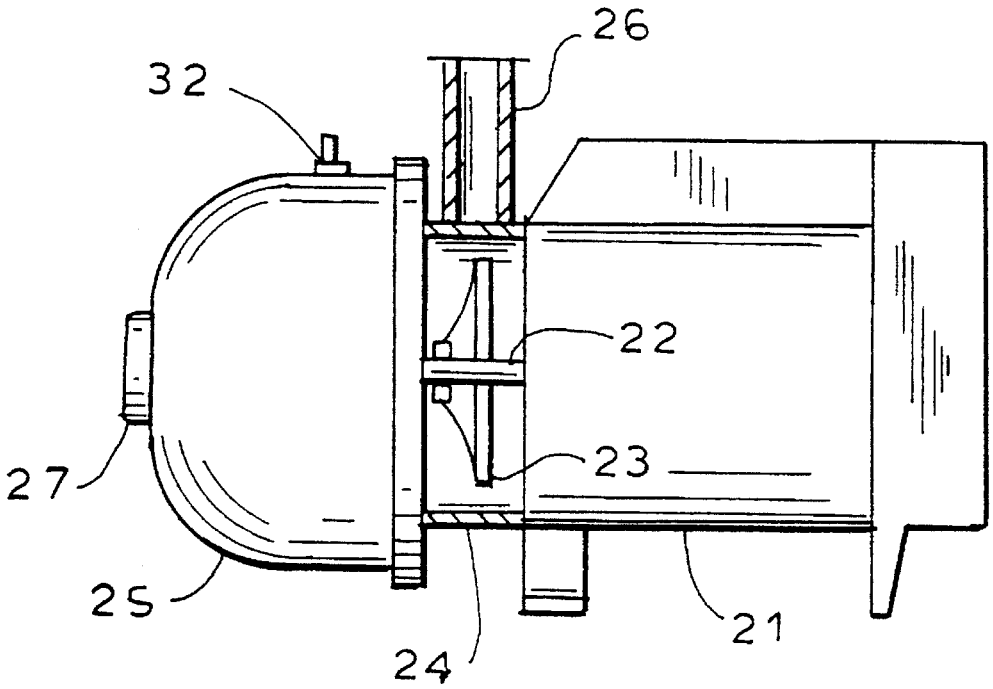
FIG. 5B is a cross-sectional view showing a construction of an automatic pump of a first embodiment according to the present invention.
Figure 6:
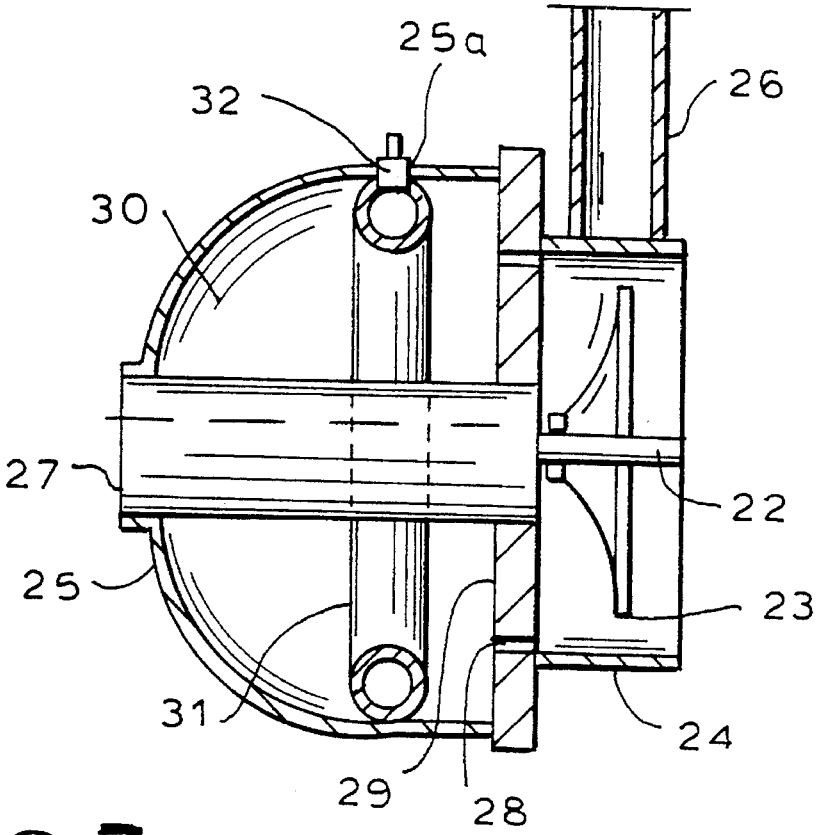
FIG. 6 is a cross-sectional view showing a pump casing and a working chamber of a first embodiment according to the present invention.

Referring to FIGS. 5A, 5B and 6, an automatic pump according to the present invention includes a motor 21 for transmitting driving force to corresponding elements thereof, an impeller 23 rotatably connected to a predetermined portion of a rotary shaft 22 of the motor 21, a working chamber 24 formed in front of the motor 21 and inside which the impeller 23 is disposed, and a pump casing 25 attached to a predetermined portion of the working chamber 24.

Figure 1A:
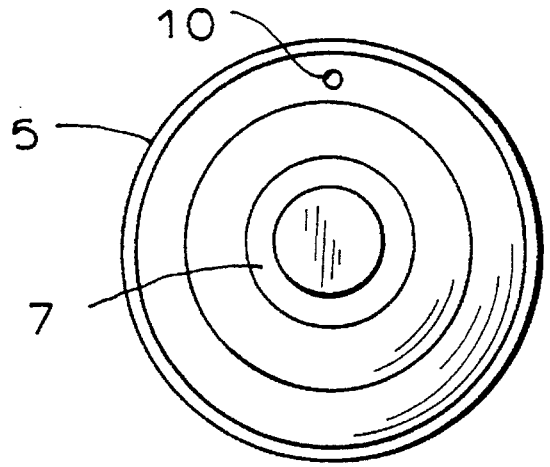
FIG. 1A CONVENTIONAL ART
FIG. 1A is a schematic front view showing construction of a conventional automatic pump.
Figure 1B:
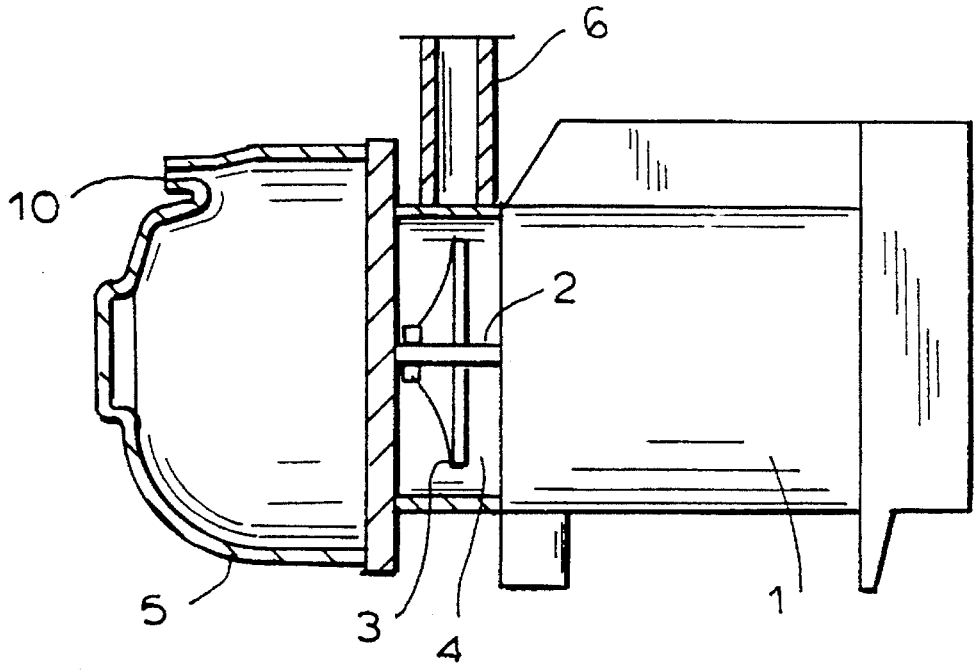
FIG. 1B CONVENTIONAL ART
FIG. 1B is a cross-sectional view showing a schematic construction of a conventional automatic pump.
Figure 2:
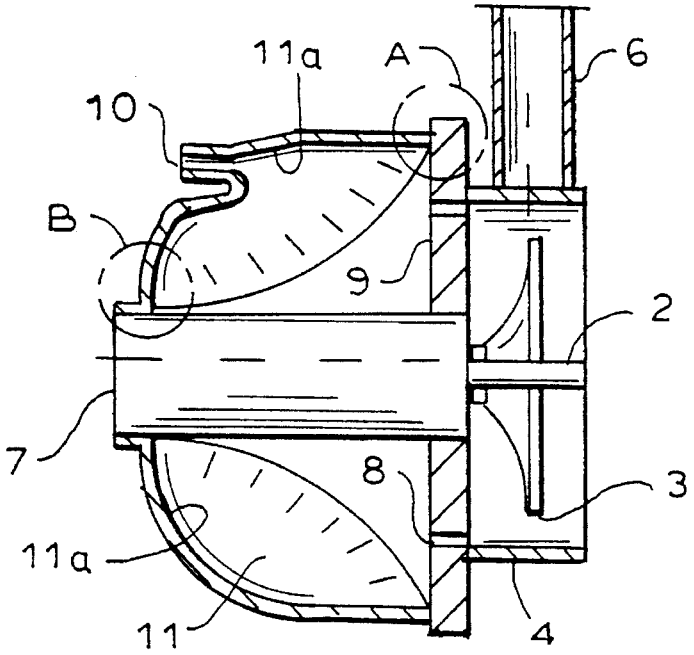
FIG. 2 CONVENTIONAL ART
FIG. 2 is a cross-sectional view showing a pump casing and a working chamber of a conventional automatic pump, which are in the state of a pressuring operation.
Figure 3:
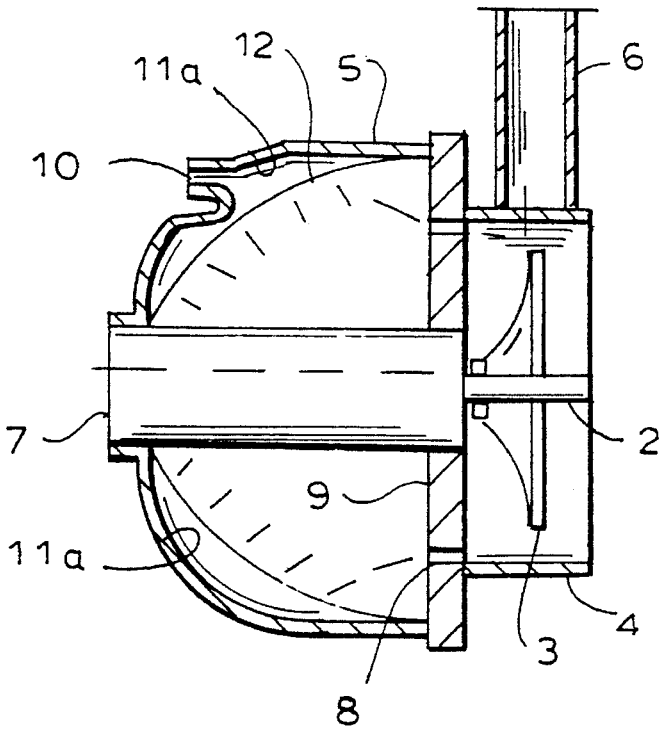
FIG. 3 CONVENTIONAL ART
FIG. 3 is a cross-sectional view showing a pump casing and a working chamber of a conventional automatic pump, which are in the state of a normal operation.
Figure 4:
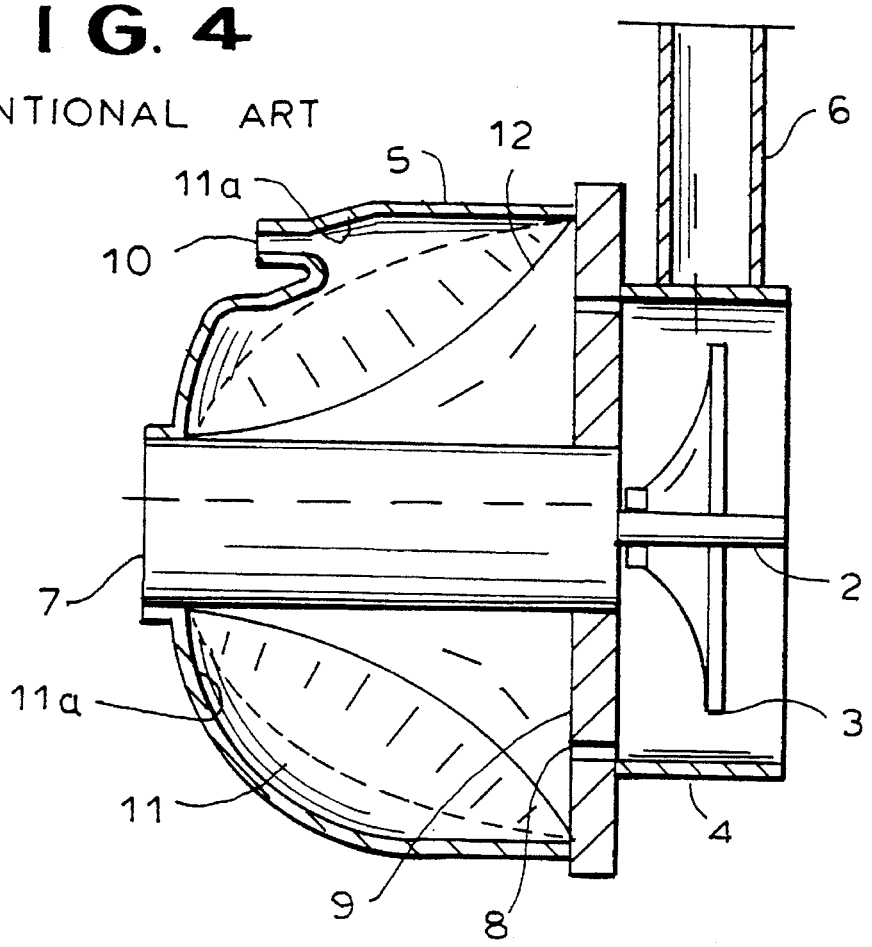
FIG. 4 CONVENTIONAL ART
FIG. 4 is a cross-sectional view showing a pump casing and a working chamber of a conventional automatic pump when the pump is turned off.

The automatic pump of a first embodiment according to the present invention is directed to include a pressure control tube 31, as shown in FIG. 6, disposed at a predetermined portion of the pump casing 25, instead of providing the rubber blade 12 shown in FIG. 2 which is commonly used in the conventional automatic pump.

The construction of the pump casing 25 will now be explained in detail with reference to FIG. 6.

To begin with, the pump casing 25 includes an intake tube 27 formed toward the working chamber 24, an intermediate wall 29 formed between the working chamber 24 and the pump casing 25 and in predetermined portions of which a plurality of pressure control openings 28 are formed, a pressure tank 30 formed between the pump casing 25 and the intermediate wall 29, and a pressure control tube 31 disposed in a predetermined portion of the pump casing 25.

Figure 8:
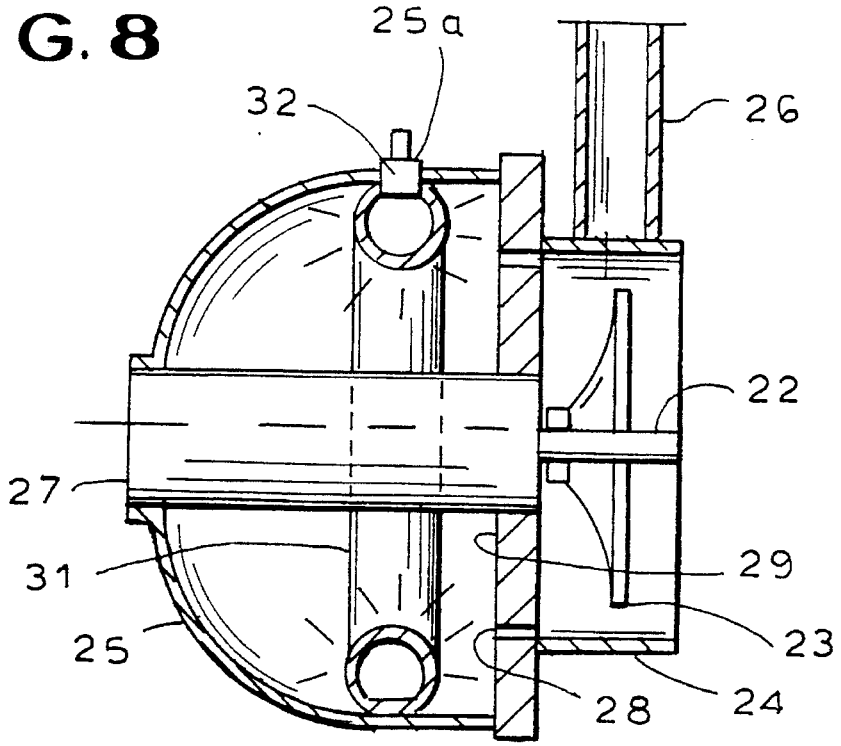
FIG. 8 is a cross-sectional view showing a pump casing and a working chamber, which are in the state of a normal operation of an automatic pump.
Figure 7:
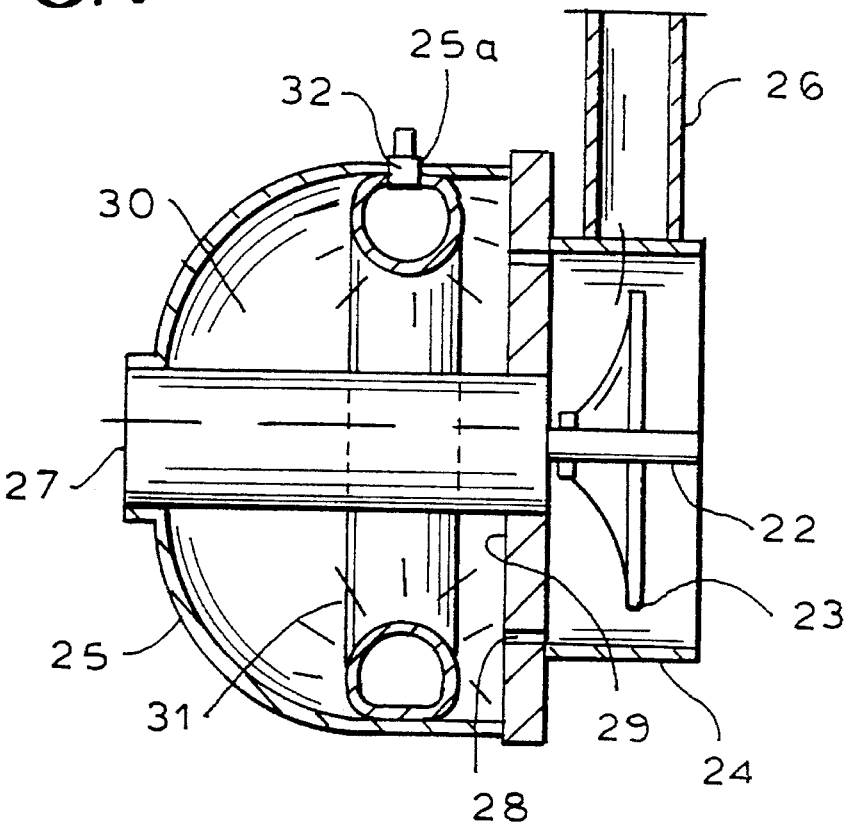
FIG. 7 is a cross-sectional view showing a pump casing and a working chamber, which are in the state of a pressuring operation of the automatic pump and when the pump is turned off.
Figure 9B:
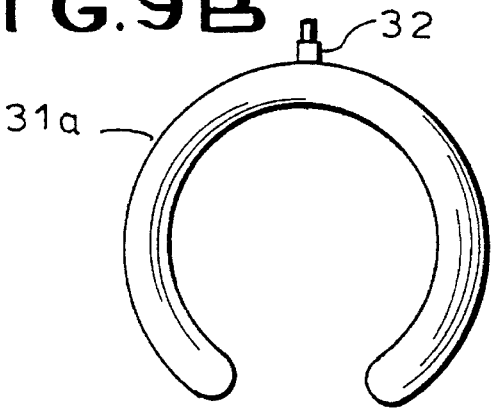
FIG. 9B is a front view showing a second embodiment of a pressure control tube adopted in the present invention.
Figure 9A:
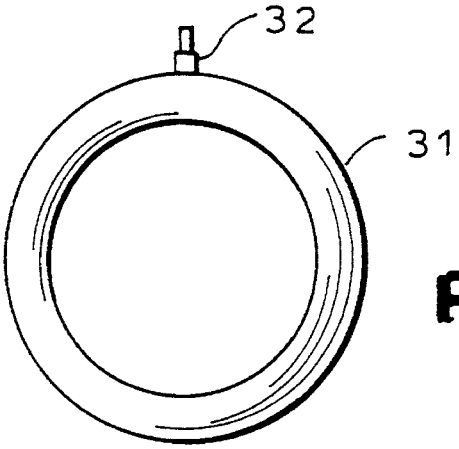
FIG. 9A is a front view showing a first embodiment of a pressure control tube adopted in the present invention.

Referring to FIG. 9A, one side of the pressure control tube 31 is provided with the air pressuring port 32, one end of which is projected to the outside by a predetermined length through the affixing opening 25*a* formed at a predetermined portion of the pump casing 25, as shown in FIGS. 6 to 8. Here, the pressure control tube 31 is firmly affixed to a predetermined portion of the inner wall of the pump casing 25, thereby preventing any operational variations therein.

Figure 9C:
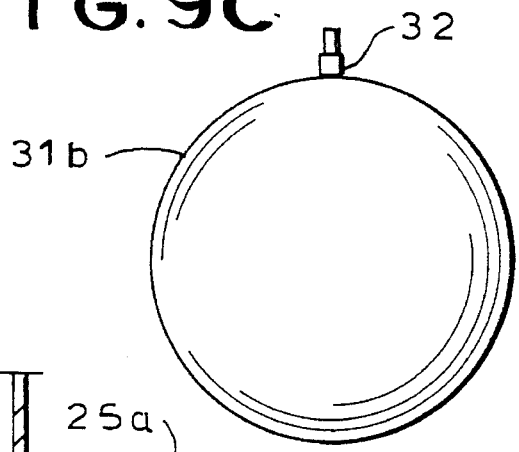
FIG. 9C is a front view showing a third embodiment of a pressure control tube adopted the present invention.

Meanwhile, the pressure control tube 31, as shown in FIG. 9A, is not restricted in its shape of construction based upon the internal structure of the pressure tank 30. That is, as shown therein, a hollow type as shown in FIG. 9A, a one side-opened type of a pressure control tube 31*a* as shown in FIG. 9B, or a spherical pressure control tube 31*b* as shown in FIG. 9C may be used.

However, in case of the spherical pressure control tube 31*b*, it needs to have smaller diameter to avoid any interference with the intake tube 27.

The operation of a the first embodiment of the automatic pump according to the present invention will now be explained.

To begin with, referring to FIG. 7, the pressure control tube 31 therein is highly pressured compared with the one shown in FIG. 6, so it looks is more expanded. Referring to FIG. 7, in the state that the pressure control tube 31 is expanded with having a predetermined pressure therein, when the impeller 23 cooperatively connected with the rotary shaft 22 of the motor 21 rotates, water flows to the working chamber 24 along the intake tube 27 as indicated by the arrows shown in FIG. 7, and then the water is exhausted to the exhausting tube 26 by means of a predetermined pressure level generated by the rotation of the impeller 23. At this time, the pressure in the pressure tank 30 of the pump casing 25 is lower than in the initial stage.

However, the higher the motor 21 runs, the more the pressure in the working chamber 24 become higher compared with the pressure in the pump casing 25, as shown in FIG. 8, so that a predetermined amount of water stored in the working chamber 24 flows into the pressure tank 30 through the pressure control openings 28 of the intermediate wall 29. Thereafter, the water flowed thereinto permits the pressure control tube to be pressured as shown in FIG. 8.

If the pump is stopped due to the problems of the motor or the exhausting pressure thereof is decreased, the pressured pressure control tube 31 becomes expanded and lets water in the pressure tank 30 flow into the working chamber 22 through the pressure control openings 28, thereby maintaining a predetermined exhausting pressure.

Figure 10:
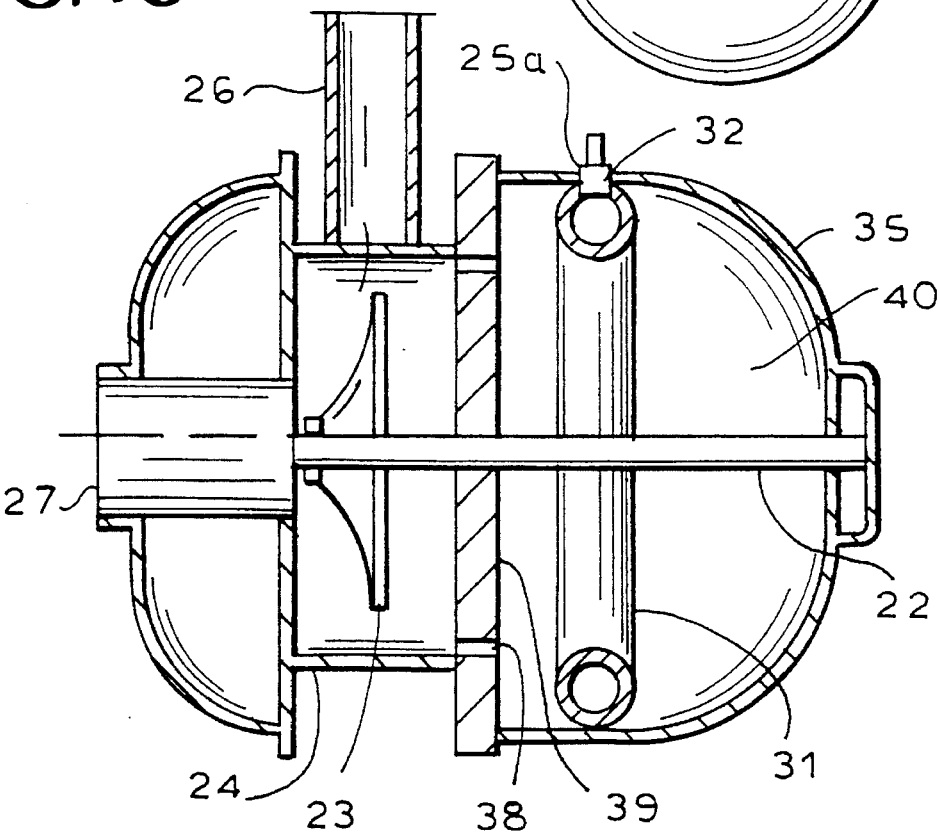
FIG. 10 is a cross-sectional view showing an automatic pump of a second embodiment according to the present invention.

Meanwhile, referring to FIG. 10, there is shown a construction of an automatic pump of a second embodiment according to the present invention. Compared with the construction of the first embodiment, the second embodiment includes an additional pump casing 35 disposed behind the working chamber 24. An intermediate wall 39 is provided with a plurality of pressure control openings 38 formed between the working chamber 24 and the pump casing 35, inside which the pressure tank is provided. In addition, a pressure control tube 31 is disposed at a predetermined inner portion of the pump casing 35 in the same manner as in the first embodiment. An air pressuring port 32 of the pressure control tube 31 is externally projected through the affixing opening 25*a* of the pump casing 35.

In the same manner as in the first embodiment, the second embodiment may include any of the plurality of the pressure control tube types 31, 31*a* and 31*b*.

As described above, the automatic pump of the second embodiment according to the present invention has advantages in alternatively disposing the pressure control tube, thereby increasing usable space therein with the same operation performance compared with the first embodiment.

Accordingly, the automatic pump according to the present invention has advantages in removing the sealing process for sealing the rubber blade according to the conventional art, thereby reducing the number of the manufacturing process steps as well as achieving better sealing performance therein. In addition, the pressure control tube may be alternatively disposed therein, thereby increasing usable space therein, whereby more compact size of the products are possible.

What is claimed is:

1. An automatic pump, comprising:

a motor for transmitting driving force to an impeller of said pump;

a working chamber formed in front of the motor, in which the impeller is disposed;

a pump casing attached to a predetermined portion of the working chamber and having a space with a predetermined size therein; and a pressure control tube equipped with an air pressurizing port disposed in a predetermined portion of the pump casing.

2. The pump of claim 1, wherein said pump casing includes an intake tube connected between an outer portion of the pump casing and the working chamber, an intermediate wall formed between the working chamber and the pump casing and having a plurality of pressure control openings therein, and a respective space formed between the pump casing the intermediate wall.

3. The pump of claim 1, wherein said pump casing is formed in front of and behind the working chamber.

4. The pump of claim 1, wherein the air pressurizing port of said pressure control tube externally projects through an affixing opening formed at a predetermined portion of the pump casing.

5. The pump of claim 1, wherein said pressure control tube is a hollow ring type.

6. The pump of claim 1, wherein said pressure control tube is a one side-opened hollow ring type.

7. The pump of claim 1, wherein said pressure control tube is a hollow spherical type.

* * * * *